US006662716B2

(12) United States Patent
Benderly

(10) Patent No.: US 6,662,716 B2
(45) Date of Patent: Dec. 16, 2003

(54) FLAME MARKING SYSTEM AND METHOD

(76) Inventor: David Benderly, 575 Main St., New York, NY (US) 10044

( * ) Notice: Subject to any disclaimer, the term of this patent is extended or adjusted under 35 U.S.C. 154(b) by 295 days.

(21) Appl. No.: 09/858,846

(22) Filed: May 16, 2001

(65) Prior Publication Data

US 2003/0085983 A1 May 8, 2003

Related U.S. Application Data

(60) Provisional application No. 60/204,506, filed on May 16, 2000.

(51) Int. Cl.[7] ..... B41P 17/00
(52) U.S. Cl. ..... 101/35; 101/488
(58) Field of Search ..... 101/35, 41, 114, 101/129, 487, 480

(56) References Cited

U.S. PATENT DOCUMENTS 4,073,992 A * 2/1978 Lerman et al. ..... 428/207
4,603,986 A * 8/1986 Simpson ..... 400/241.2

FOREIGN PATENT DOCUMENTS

EP 0119801 A2 * 9/1984

* cited by examiner

*Primary Examiner*—Daniel J. Colilla
*Assistant Examiner*—Jill E Culler
(74) *Attorney, Agent, or Firm*—Kirschstein, et al.

(57) ABSTRACT

Diamonds are marked by applying apertured tapes bearing identifying indicia to the girdles, applying a flammable layer over the apertured tapes, and then igniting the flammable layer to burn the indicia into the girdles. Preferably, the flammable layer is prepackaged within the apertured tapes.

17 Claims, 1 Drawing Sheet

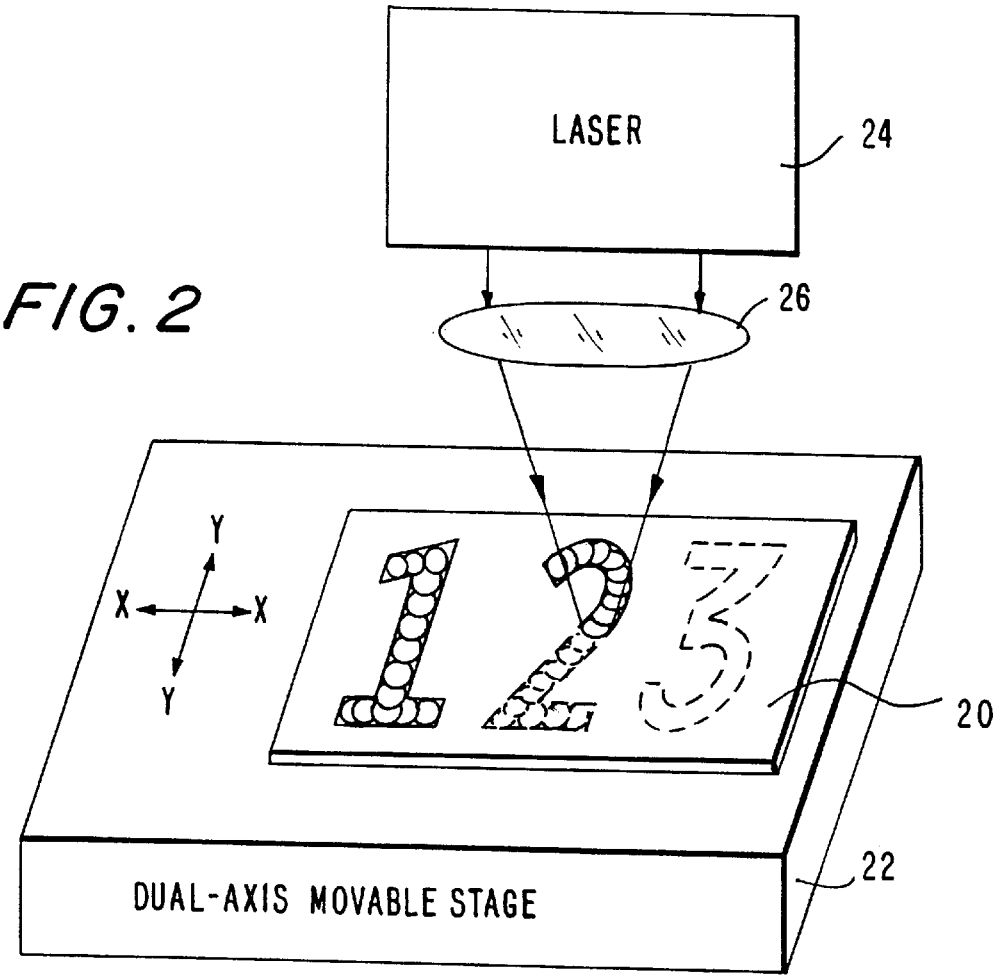
FIG. 2
FIG. 1
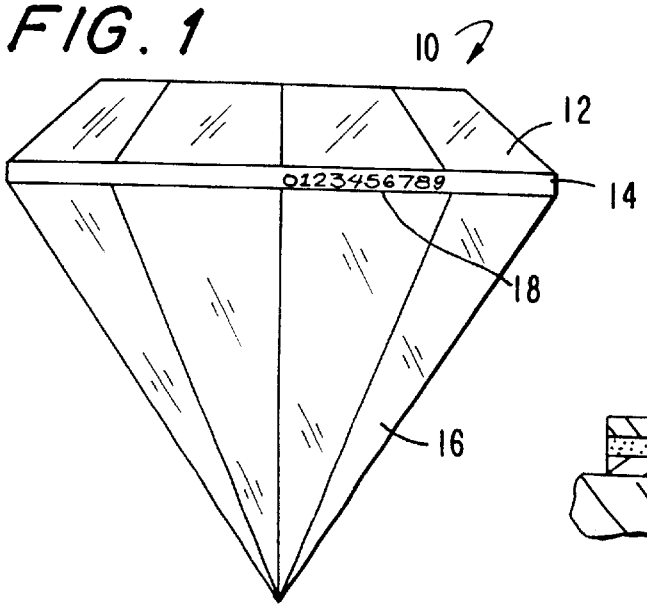
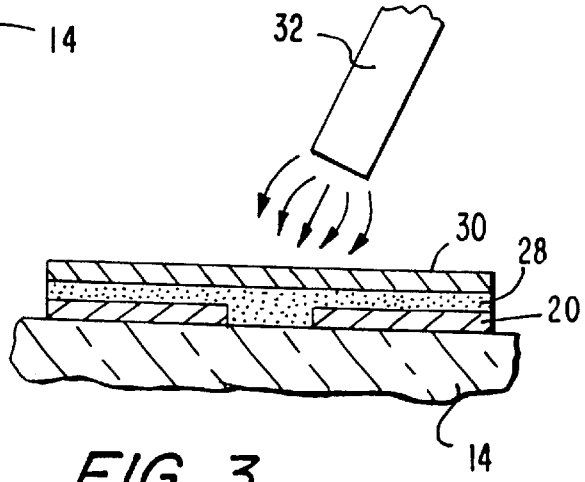
FIG. 3

FLAME MARKING SYSTEM AND METHOD

CROSS REFERENCE TO RELATED APPLICATIONS

This application claims the benefit of U.S. Provisional Patent Application Ser. No. 60/204,506, filed May 16, 2000.

BACKGROUND OF THE INVENTION

1. Field of the Invention

The present invention generally relates to marking and inscribing gemstones, particularly diamonds, with indicia identifying the gemstones by scorching surface portions of the gemstones in a burn pattern corresponding to the identifying indicia.

2. Description of the Related Art

Laser etching or inscribing of a diamond surface for the purpose of permanently identifying a diamond is well known. U.S. Pat. No. 4,392,476; No. 4,467,172; No. 5,753,887; No. 5,932,119; No. 5,149,938; No. 5,410,125; No. 5,573,684; No. 6,211,484 and application Ser. No. 09/785,631 filed Feb. 16, 2001 are representative of the prior art of laser marking systems that employ lasers, beam delivery and imaging components, gemstone fixtures, servomotors, optical encoders, and programmed computers for controlling the marking procedure.

Such marking systems not only occupy a large volume of space to accommodate all of their various components, but also are costly to purchase and operate. As a result, such systems are typically installed at one or more authorized sites, such as a gemological laboratory or institute. Jewelers and like customers desiring gemstones to be marked send the gemstones to the site of the marking system, and wait for the marked gemstones to be returned.

Many jewelers dislike sending precious items out of their hands and, hence, out of their sight and control, but perhaps, more importantly, dislike having to wait for their return. Yet, the size and cost of laser marking systems dictate against any one jeweler's purchasing and installing such a system at the jeweler's premises. Such systems also require skilled, trained personnel to operate the system. This requirement is typically difficult for the average jeweler to meet.

SUMMARY OF THE INVENTION

Objects of the Invention

One object of this invention is to enable gemstones to be marked with identifying indicia without using large sized, costly laser marking systems.

Another object of this invention is to reduce the skill level required for personnel to mark gemstones.

Still another object of this invention is to enable gemstone marking on-site at a jeweler's premises.

Yet another object of this invention is to increase the use of gemstone marking by making the procedure more available and affordable to jewelers.

Features of the Invention

In keeping with these objects, one feature of this invention resides in a flame marking system and method that mount an apertured tape on a surface of a gemstone, for example, on a diamond girdle. The tape has cutouts corresponding to identifying indicia for the diamond. A flammable substance or mixture having a melting point greater than that of the diamond is applied over the tape and fills the cutouts. The substance or mixture is ignited to scorch the girdle in a burn pattern corresponding to the cutouts and the indicia. A cover tape may be applied over the flammable substance or mixture prior to ignition. The tape may be pre-filled with the flammable substance or mixture and covered on both sides.

The marking can be performed at a jeweler's premises. No costly and large-sized machines for directly marking the diamond with a laser beam need be purchased or operated.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a side elevational view of a marked gemstone according to this invention;

FIG. 2 is a schematic view of the process for making an apertured tape according to this invention; and FIG. 3 is a sectional view of the apertured tape mounted on a gemstone during marking.

DETAILED DESCRIPTION OF THE PREFERRED EMBODIMENTS

Reference numeral 10 in FIG. 1 schematically depicts a diamond having a crown 12, a girdle 14, and a pavilion 16. The girdle 14 is a peripheral band between the crown and the pavilion and, in the preferred embodiment, an identifying indicium or mark 18 is formed on the girdle. The mark 18 can be a machine-readable indicium, such as a one- or a two-dimensional bar code symbol, or can be a human-readable indicium, such as an alphabetical and/or numerical indicium, or can be a logo or image, for example, a certification mark of quality or of source of origin. The mark is permanently inscribed and is substantially imperceptible to the naked eye, although clearly visible under magnification such as by a ten power loupe.

In accordance with this invention, the mark is formed as follows: First, as depicted in FIG. 2, a generally planar tape 20 is mounted on a table 22 that is independently movable by two DC servomotors along mutually orthogonal directions (X, Y) by microprocessor control. The tape 20 is constituted of a fire-resistant material, preferably a metal, having a high melting temperature as explained below. One or both sides of the tape may bear an adhesive layer.

Next, a laser 24, also under control of the microprocessor, is actuated to direct its laser beam at the tape to form one or more cutouts, such as the depicted numerals 1, 2, 3. The laser beam is focused by a lens 26 to form a spot on the tape. The spot burns entirely through the tape. Movement of the tape and the table under microprocessor control relative to the spot causes the spot to form a cutout in the desired shape such as the numerals 1, 2, 3. Numeral 1 is shown in solid lines already formed. Numeral 2 is in the process of being formed. Numeral 3 is shown in dashed lines and is waiting to be formed. Rather than moving the tape, the laser beam may be moved by moving beam-steering mirrors along the mutually orthogonal directions relative to a stationary table.

The manufacture of the resulting apertured tape is preferably performed not by the jeweler or ultimate user, but instead, by an authorized tape supplier who has the facilities and equipment to make the tape. Thus, a jeweler may pre-order a supply of apertured tapes, for example, with sequential numbers in a series, or with a logo, from the tape supplier.

With the supply of apertured tapes on hand at the jeweler's premises, the jeweler selects a tape and applies it along the girdle of a gemstone to be marked. Preferably, the tape has an adhesive surface that adheres to the girdle.

Next, the apertured tape is dusted with a layer 28 of a flammable substance or mixture having a melting point exceeding that of the gemstone, e.g., diamond, to be marked. Preferably, the flammable ingredient is powdered magnesium or sulfur that fills each cutout. The mixture may include a fire-starting ingredient to help ignite the flammable ingredient. The flammable layer 28 is preferably covered with a cover tape 30 (see FIG. 3) to prevent the flammable layer from scattering. Other than dusting, the flammable substance can be sprayed, painted, or otherwise applied over the tape 20.

The jeweler then ignites the magnesium, typically by directing a flame from a burner 32 against the tape. Rather than using a burner, this invention also contemplates directing a laser against the tape. In another embodiment, an electrical current can be passed through a resistive wire which, when heated, causes the magnesium to ignite. The cover tape 30, if present, may simply incinerate. The magnesium will burn hot enough through the cutouts in the tape 20 to eventually form pits or craters in the surface of the girdle. These craters or burn pattern will match the shape of the cutouts which, of course, were made in advance with the identifying indicia. The higher melting point of the tape 20 insures that the burn pattern will largely remain in, and conform to, the shape of the cutouts.

The last step is to remove the tape and clean the gemstone, preferably in an acetone or acid wash. The resulting marked gemstone conforms to that shown in FIG. 1.

Variations to this marking technique include using a tubular, rather than a flat, tape which is pre-filled with the flammable substance. This avoids requiring the jeweler to apply the flammable substance over the tape, and to thereupon cover the substance.

Another variation includes covering each side of the apertured tape 20 with the cover tape 30. The resulting tape assembly sandwiches the flammable layer between two cover tapes. This is currently the preferred embodiment because it enables the authorized tape supplier to sell a prepackaged tape already applied with the indicia and prefilled with the flammable layer, and eliminates the need for the jeweler to work directly with the flammable ingredients.

Instead of forming the indicia with a laser beam, the cutouts can be formed using other techniques such as applying a photoresist layer and exposing selected portions to light such as ultraviolet light.

The marking can be performed on any outer surface of the gemstone, and not necessarily on the girdle. The gemstone need not necessarily be a diamond.

Thus, marking is achieved at a jeweler's premises. The skill involved in applying a tape, then applying the flammable layer and the cover tape, then igniting the flammable layer, and cleaning the marked gemstone, or alternatively, the skill involved in applying, igniting and cleaning a prepackaged tape assembly, is well within the expertise of the jeweler. Costly and large-sized machines for directly marking the gemstone with a laser beam are not used.

It will be understood that each of the elements described above, or two or more together, also may find a useful application in other types of constructions differing from the types described above.

While the invention has been illustrated and described as embodied in a flame marking system and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A heat marking system for marking an object having a melting point, comprising:

a) a carrier tape constituted of a material resistant to a temperature above the melting point of the object, the carrier tape having an adhesive layer and cutouts extending therethrough; and b) a flammable medium supported by the tape and filling the cutouts in a pattern corresponding to indicia to be marked on the object, the flammable medium being burnable at a temperature greater than the melting point of the object to burn the object and transfer the indicia pattern to the object upon burning of the flammable medium.

2. The marking system of claim 1; and further comprising a cover overlying the flammable medium.

3. The marking system of claim 1, wherein the flammable medium is a mixture that includes a fire-starting ingredient.

4. A heat marking system for marking a diamond having a melting point, comprising:

a) a carrier tape constituted of a material resistant to a temperature above the melting point of the diamond, the carrier tape having an adhesive layer and cutouts extending therethrough and arranged in a pattern corresponding to indicia to be marked on the diamond; and b) a flammable medium supported by the tape and filling the cutouts, the flammable medium being burnable at a temperature greater than the melting point of the diamond to burn the diamond and transfer the indicia pattern to the diamond upon burning of the flammable medium.

5. The marking system of claim 4; and further comprising a cover overlying the flammable medium.

6. The marking system of claim 4, wherein the flammable medium is a mixture that includes a fire-starting ingredient.

7. The marking system of claim 4, wherein the flammable medium includes powdered magnesium.

8. A method of marking an object having a melting point, comprising the steps of:

a) forming cutouts in a pattern corresponding to indicia to be marked on the object through a carrier tape;

b) filling the cutouts with a flammable medium which is burnable at a temperature greater than the melting point of the object;

c) mounting the tape with the cutouts filled with the flammable medium on the object to be marked; and d) igniting the flammable medium to burn the object and transfer the indicia pattern to the object.

9. The method of claim 8; and further comprising the step of overlying the flammable medium with a cover.

10. The method of claim 8; and further comprising the step of depositing an adhesive layer on the tape.

11. The method of claim 8, wherein the igniting step is performed by applying a flame to the flammable medium.

12. The method of claim 8, wherein the forming step is performed by forming the indicia as numerals.

13. The method of claim 8; and further comprising the step of removing the tape from the object after the flammable medium has ceased burning.

14. A heat marking system for inscribing a gemstone having a melting point, comprising:

a) a fire-resistant carrier tape constituted of a metallic material resistant to a temperature above the melting point of the gemstone, the tape being mounted on the gemstone; and b) a flammable medium supported by the tape and arranged in a pattern corresponding to indicia to be inscribed on the gemstone, the flammable medium being burnable at a temperature greater than the melting point of the gemstone to burn the gemstone and inscribe the indicia pattern to the gemstone upon burning of the flammable medium.

15. The marking system of claim 14, wherein the carrier tape has cutouts extending therethrough and filled with the flammable medium.

16. The marking system of claim 14; and further comprising a cover overlying the flammable medium.

17. The marking system of claim 14, wherein the flammable medium is a mixture that includes powdered magnesium.

* * * * *